US007841221B2

(12) United States Patent
Hill et al.

(10) Patent No.: US 7,841,221 B2
(45) Date of Patent: Nov. 30, 2010

(54) LOCK ASSEMBLY FOR A STORAGE CABINET

(75) Inventors: Eric Hill, Paw Paw, MI (US); Kirk Hines, Fennville, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 11/715,079

(22) Filed: Mar. 7, 2007

(65) Prior Publication Data

US 2007/0227205 A1 Oct. 4, 2007

Related U.S. Application Data

(60) Provisional application No. 60/787,833, filed on Mar. 31, 2006.

(51) Int. Cl.
*E05B 63/14* (2006.01)
*E05B 65/44* (2006.01)

(52) U.S. Cl. ..... 70/120; 70/82

(58) Field of Classification Search ..... 70/120, 70/118, 82, 121, 117, 119, 83, 78; 292/337, 292/34, 36, 335
See application file for complete search history.

(56) References Cited

U.S. PATENT DOCUMENTS

| | | | | | |
|---|---|---|---|---|---|
| 446,789 | A | * | 2/1891 | Reed | 70/120 |
| 1,046,438 | A | * | 12/1912 | Caldwell | 70/358 |
| 2,188,703 | A | | 1/1940 | Burke | |
| 2,250,036 | A | * | 7/1941 | Schlage | 292/1.5 |
| 2,272,145 | A | * | 2/1942 | Anderson et al. | 292/7 |
| 2,293,363 | A | * | 8/1942 | Schell | 292/37 |
| 2,473,065 | A | * | 6/1949 | Miller | 292/37 |
| 2,486,460 | A | | 11/1949 | Bonenberger | |
| 2,591,111 | A | * | 4/1952 | Willett et al. | 70/355 |
| 2,823,536 | A | | 2/1958 | Watson | |
| 3,834,780 | A | | 9/1974 | McClellan et al. | |
| 4,114,933 | A | * | 9/1978 | Jankelewitz et al. | 292/37 |
| 4,368,905 | A | * | 1/1983 | Hirschbein | 292/5 |
| 4,534,192 | A | * | 8/1985 | Harshbarger et al. | 70/118 |
| 4,609,233 | A | * | 9/1986 | Walla | 312/219 |
| 4,823,571 | A | | 4/1989 | O'Gara | |
| 5,183,310 | A | * | 2/1993 | Shaughnessy | 296/106 |
| 5,632,166 | A | | 5/1997 | Wiersma | |

(Continued)

FOREIGN PATENT DOCUMENTS

DE 4202085 A1 * 8/1993

*Primary Examiner*—Suzanne Dino Barrett
*Assistant Examiner*—Alyson M Merlino
(74) *Attorney, Agent, or Firm*—Flynn, Thiel, Boutell & Tanis, P.C.

(57) ABSTRACT

A lock assembly is provided which includes a lock mechanism with cover, and a pair of vertically movable locking rods. The lock mechanism is readily mountable to a liner of a cabinet door by a clamp member which permits initial clamping of the mechanism on an inner liner of the door, after which the inner liner is mounted to an outer finish panel. After assembly of the inner liner to the outer panel, the lock assembly is clamped in an aligned position in alignment with a corresponding lock aperture in the outer panel. The lock assembly further includes a fastener-free connector arrangement between a lock rack of the lock mechanism and the locking rods which is slidably driven thereby. A cover is snap fittingly mounted on the inner liner to guide the locking rod and prevent disengagement from the lock rack.

23 Claims, 13 Drawing Sheets

U.S. PATENT DOCUMENTS 5,660,420 A * 8/1997 Smith et al. ..... 292/3
5,737,950 A 4/1998 Yun-Bin
5,775,145 A 7/1998 Kasper
5,806,353 A 9/1998 Pages
6,018,969 A 2/2000 Haseley et al.
6,067,827 A 5/2000 Haseley et al.
6,257,154 B1 * 7/2001 Kasper ..... 109/73
6,568,771 B2 5/2003 Gentili et al.
6,722,170 B2 4/2004 Squier

* cited by examiner 34
32
64
12
59
14
43
30
45
37
36
35
44
28
65
65
31
41
47
57
14
47
33

30
35
36
61
37
26
39
64
12
31
28
25
43
50
44
45
27
40
61
47
58
47
34

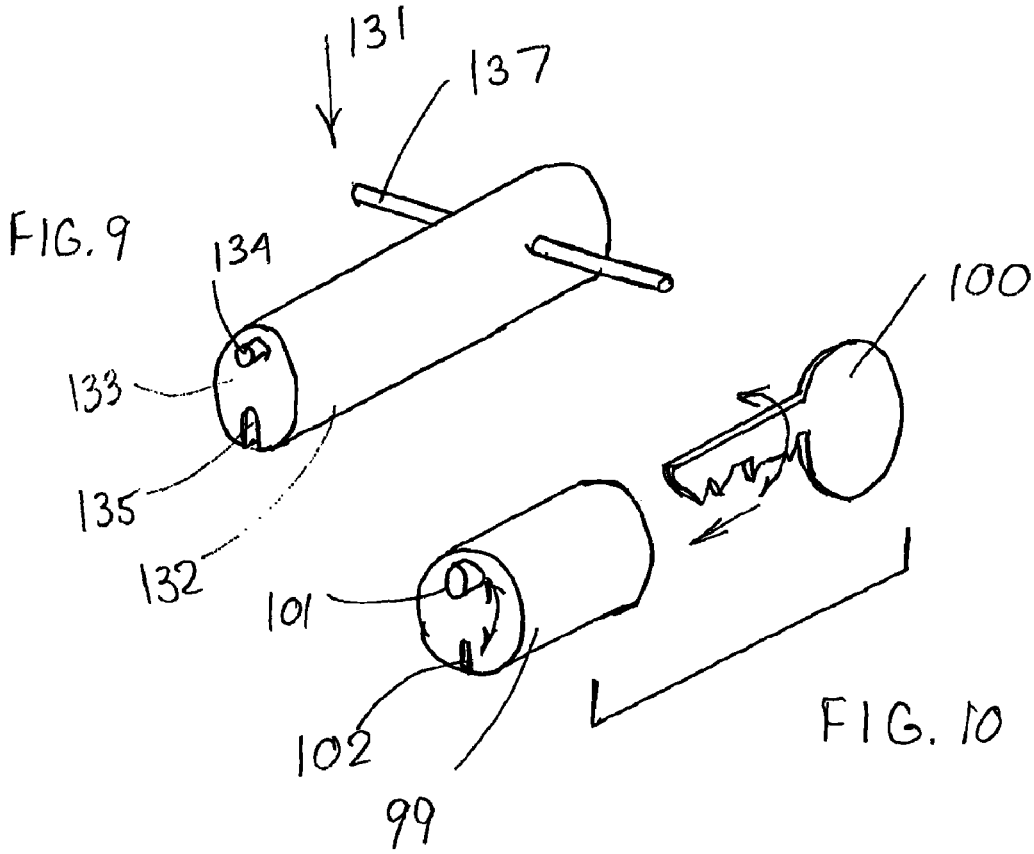
FIG. 9
FIG. 10
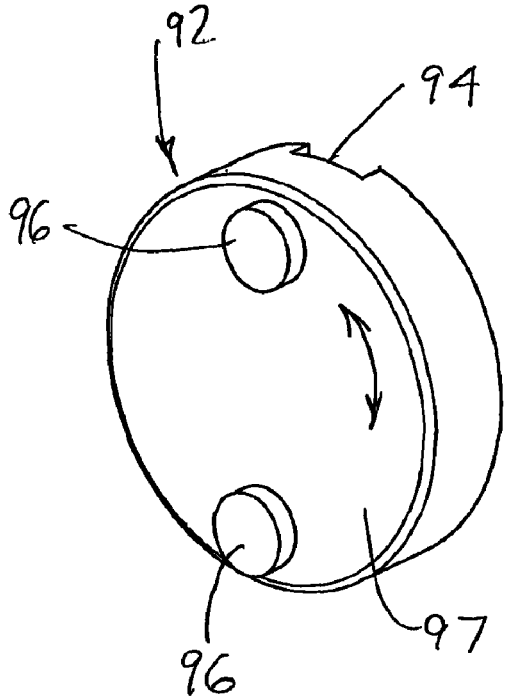
FIG. 11

FIG. 21
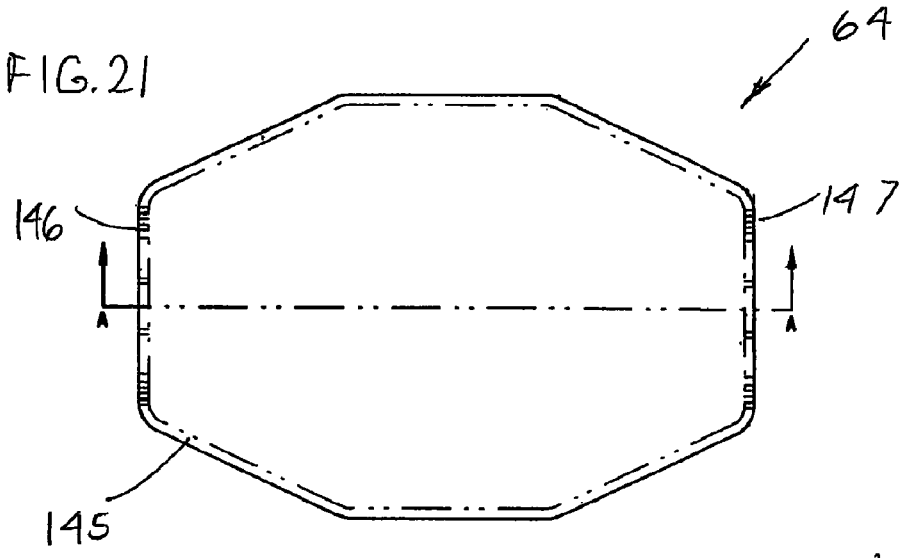
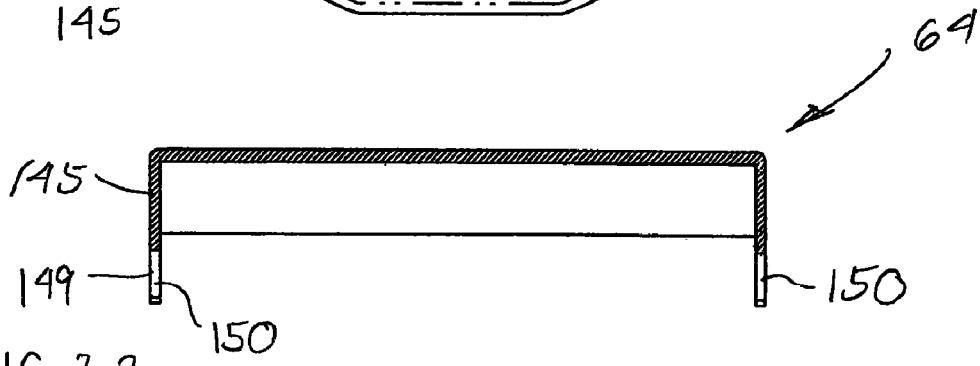
FIG. 22
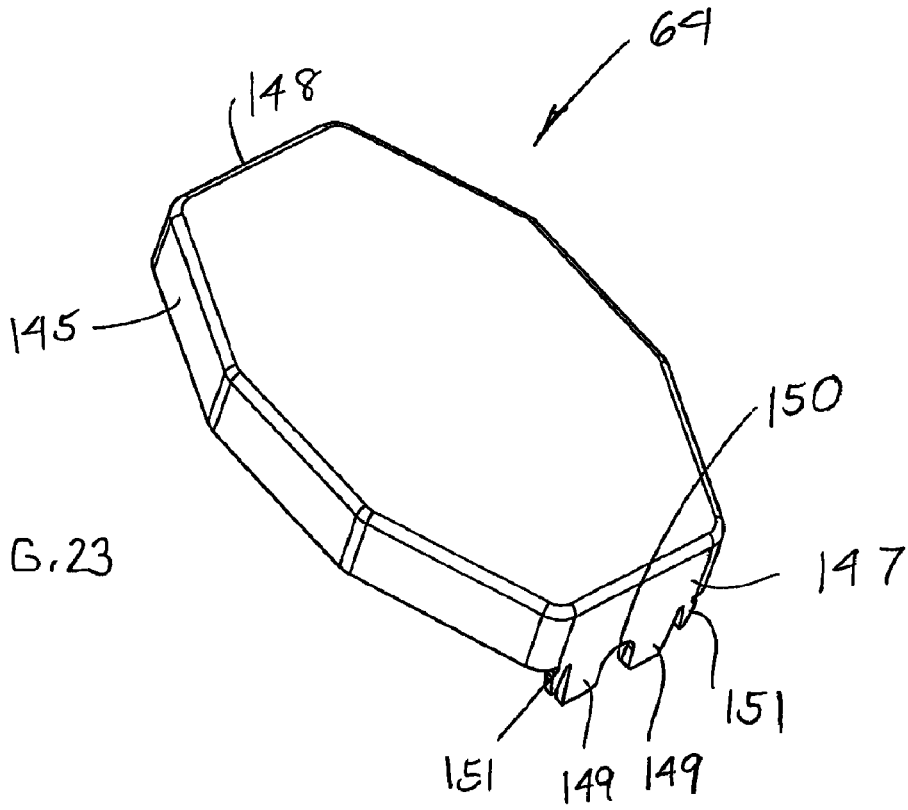
FIG. 23

LOCK ASSEMBLY FOR A STORAGE CABINET

CROSS REFERENCE TO RELATED APPLICATION

This application claims the benefit of U.S. Provisional Patent Application No. 60/787,833, filed Mar. 31, 2006, which is incorporated herein by reference in its entirety.

FIELD OF THE INVENTION

The invention relates to a cabinet construction having a door assembly that includes an improved lock assembly mounted thereto.

BACKGROUND OF THE INVENTION

Cabinets as used in offices comprise a conventional cabinet housing and one or more hinged doors mounted thereto. Many such cabinets are formed of sheet steel or other similar metal and include lock mechanisms mounted to such doors for selectively latching or locking the door in a closed position.

The invention relates to an improved door assembly and associated lock mechanism which lock mechanism is readily mountable to the door and positionable in proper alignment with a lock aperture formed in the front face of the door.

Generally, the door construction comprises an outer panel which defines the finished aesthetic appearance of the door, and an inner liner which mounts in facing relation to the outer panel. The outer panel includes the lock aperture through which a key is insertable to actuate the lock mechanism for locking and unlocking thereof.

The inner liner includes a lock mounting window in which the lock mechanism is mounted. The lock mechanism initially is mounted in the mounting window by a clamp ring on the lock mechanism. Thus, the lock mechanism is preliminarily mounted on the inner liner, after which the inner liner is then mounted to the outer panel with the lock mechanism preliminarily positioned adjacent to the lock aperture.

The inventive lock mechanism includes an alignment tool which is insertable through the lock aperture from the front thereof and into a corresponding cylinder bore in which a lock cylinder or plug will subsequently be seated. Before the lock plug is inserted, however, the alignment tool is inserted in the bore so that the lock bore may be aligned with the corresponding lock aperture. Once the bore and aperture are aligned, the clamp ring is then tightened in a fixed, final position so that the lock assembly is properly and stationarily aligned with the lock aperture. Thereafter, the lock plug is inserted into the bore to permit key-operation of the lock mechanism.

The lock mechanism of the invention further includes a cam driven arrangement of lock racks which are moveable upwardly and downwardly in opposite directions. The mechanism further includes elongate locking rods or latches which extend from the lock mechanism upwardly to the upper and lower perimeter edges of the door so as to be selectively extended and retracted for respective locking and unlocking of the door. The inventive lock mechanism includes an improved connector arrangement between the locking rod and the corresponding lock rack.

More particularly, the lock rack includes a sideward opening engagement slot which opens sidewardly, transversely to the direction of movement of the lock rack. The locking rod includes a drive end which is slidably received within this slot in the sideward, transverse direction so that vertical displacement of the lock rack causes a corresponding longitudinal displacement of the locking rod. To prevent disengagement of the drive end of the locking rod from the lock rack, a snap fit cover is snap lockingly connected to the lock window. This cover includes guide sections or flanges which define vertically spaced guide slots that each slidably fits over a respective one of the locking rods and permits longitudinal movement of the respective locking rod while preventing sideward, transverse movement of the drive end which thereby prevents disengagement of the locking rod from the corresponding lock rack. This cover also closes off the lock mechanism from the interior of the cabinet to provide a finished appearance.

Generally therefor, the invention relates to a door assembly for a storage cabinet which comprises a door having a lock window therein within an interior portion thereof, and at least one locking rod which is slidably supported by the door so as to be movable along a slide path. The locking rod has a lock end disposed adjacent an edge of the door so as to be movable to an extended position to lock the door and a retracted position to permit opening of said door. The locking rod further includes a drive end disposed within the area of the lock window. The door assembly also includes a lock mechanism having a lock housing mounted to the door such that the lock mechanism is disposed within the lock window. The lock mechanism further includes at least one lock rack which is slidable along a drive path and further includes an actuator accessible from an exterior of the door to effect selected displacement of the lock rack. The lock rack and the drive end of the locking rod are engagable with each other such that displacement of the locking rod effects displacement of the locking rod along the respective slide path to effect locking and unlocking of said door. The drive end of the locking rod and the respective lock rack include cooperating engagement portions which are inter-fitted with each other by displacement of the drive end transverse to said drive path. Still further, the door assembly has a lock mechanism cover which is releasably fixed to the door so as to overlie the lock mechanism. The cover includes a rod guide for the locking rod which fits over the locking rod and prevents transverse displacement of the locking rod and prevents disengagement of the locking rod from the respective lock rack. The rod guide permits longitudinal sliding of the locking rod when driven by the lock rack.

With this arrangement, an improved lock mechanism and door configuration is provided which allows for ready assembly and alignment of the lock mechanism and the connection of the slide rods to the remaining components of the lock mechanism.

Other objects and purposes of the invention, and variations thereof, will be apparent upon reading the following specification and inspecting the accompanying drawings.

BRIEF DESCRIPTION OF THE DRAWINGS

FIG. 9 is an isometric view of an alignment tool or fixture.

FIG. 10 is an exploded isometric view of a lock plug and associated key.

FIG. 11 is an isometric view of a rotatable cam for the lock assembly.

FIG. 21 is a rear outer view of a cover of the lock assembly.

FIG. 22 is a side cross-sectional view of the cover as taken along line A-A of FIG. 21.

FIG. 23 is a perspective view of the cover.

Figure 1:
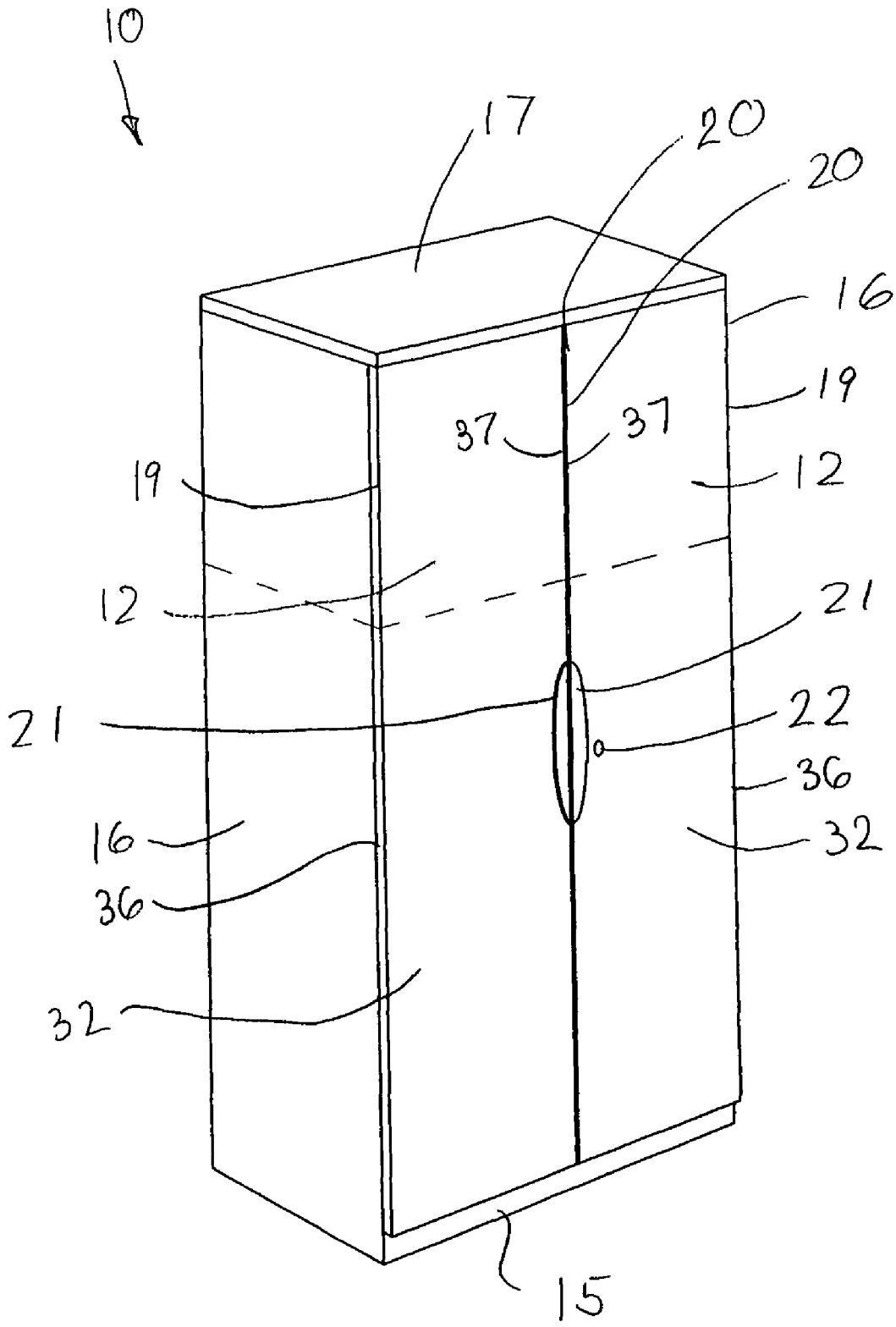
FIG. 1 is an isometric view of a storage cabinet.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figures 2, 3:
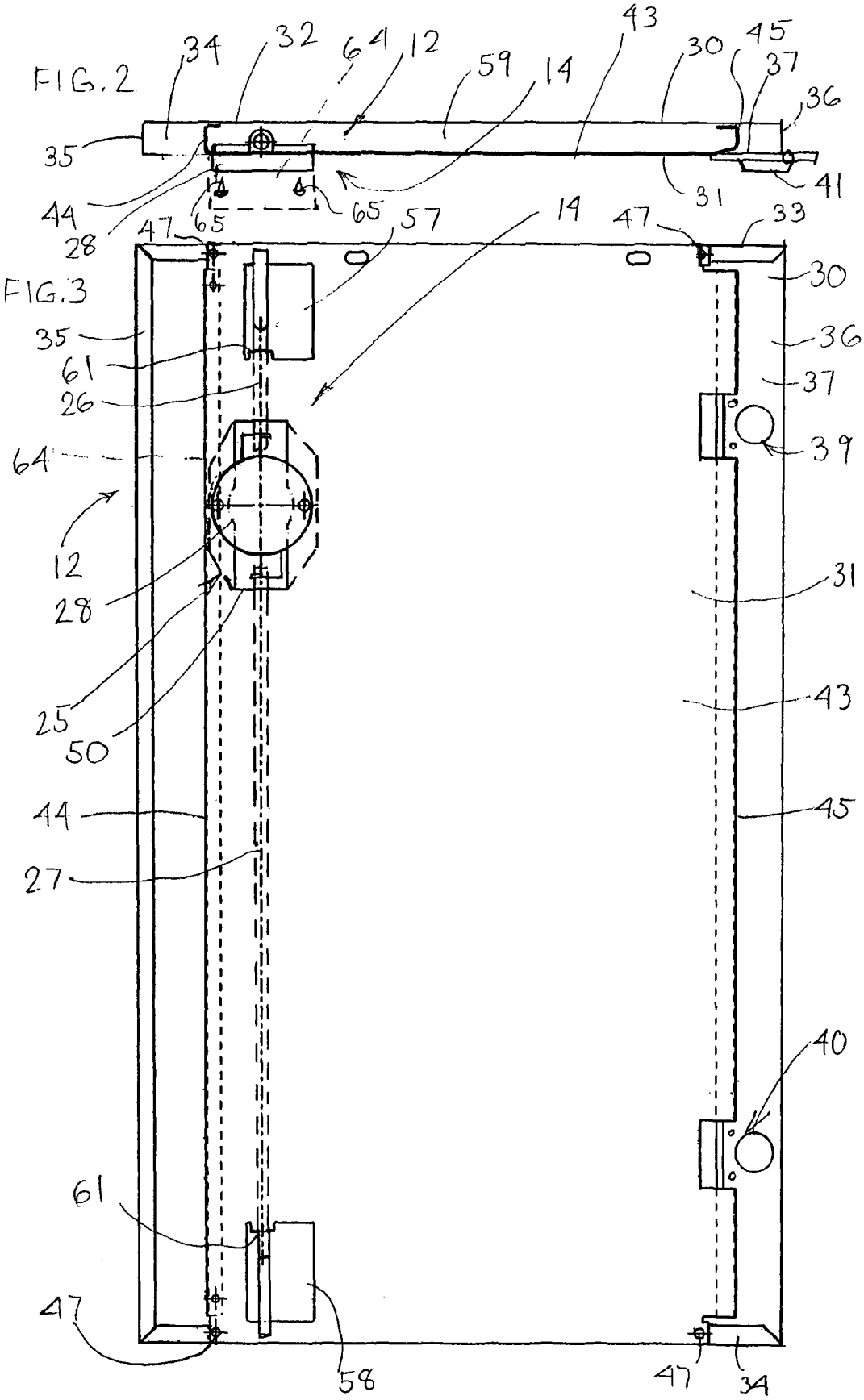
FIG. 2 is a plan view of the door assembly for the storage cabinet.
FIG. 3 is a rear elevational view thereof.

Referring to FIGS. 1-3, the invention relates to an improved storage cabinet 10 (FIG. 1) and in particular, to an improved door assembly 12 which includes a unique lock arrangement 14 mounted thereon.

Generally with respect to the cabinet unit 10, this cabinet unit 10 includes a conventional base 15 on which is supported opposite side walls 16 which in turn support a top cabinet wall 17.

The side walls 16 rigidly support a pair of door assemblies 12 at hinged edges 19 which door assemblies have free edges 20 that are disposed adjacent to each other when the door assemblies 12 are in the closed position of FIG. 1. The door assemblies 12 further include hand pulls 21 which are disposed adjacent to a lock aperture 22. The height of the cabinet 10 is illustrated in solid outline, with it being understood that the inventive lock configuration 14 is readily adapted to alternative cabinet heights such as that indicated by the dotted line in FIG. 1.

Referring to FIGS. 2 and 3, the lock configuration 14 generally comprises a lock assembly 25, which is clamped in part to the door assembly 12 and cooperates with upper and lower locking rods or latch members 26 and 27 respectively of the configuration 14. The locking rods 26 and 27 are slidably supported on the door assembly 12 so as to be vertically movable from the retracted, unlocked position illustrated in FIGS. 3 and 17 to the extended, locking position generally illustrated in FIG. 18. The lock assembly 25 further includes a lock mechanism 28 which itself is clamped to the door assembly 12, wherein the locking rods 26 and 27 are driven by the lock mechanism 28 in opposite vertical directions so as to define a two-point locking cooperation or engagement with the respective top and bottom cabinet walls 17 and 15.

More particularly as to the door assembly 12, the preferred door assembly 12 includes an outer panel 30 and an inner panel-like liner 31. The outer panel 30 preferably is formed of sheet metal which is shaped into an appropriate configuration wherein the outer panel 30 comprises a front wall 32 which is inturned to define top, bottom and side flanges 33-36 respectively. The side flange 36 further turns inwardly to define a back flange 37 which extends inwardly partially across the width of the entire outer panel 30. This back flange 37 includes upper and lower patterns of holes 39 and 40 which respectively support upper and lower hinges 41 thereon for hingedly connecting the door assembly 12 to the respective side wall 16.

With this arrangement, the front wall 32 of the outer panel 30 defines the exposed outer face of the door assembly 12.

Referring to the inner liner 31, this inner liner 31 also is formed of a shaped sheet metal having a thin panel portion 43 which essentially defines the back wall of the door assembly 12. The panel portion also includes inturned side flanges 44 and 45 which project forwardly and are adapted to terminate closely adjacent the inside face of the outer panel 30 as can be seen in FIG. 2.

The upper and lower edges of the panel portion 43 are provided with fastener holes 47 so that the inner liner 31 may be fastened by screws to the outer panel 30 during assembly of the door assembly 12. It is noted that the side flange 45 of the inner liner cooperates with the corresponding side flange 36 of the outer liner 30 so as to provide support to each other.

As to the opposite side of the inner liner 31, this side flange 44 is spaced inwardly a short distance away from the corresponding side edge 35 of the outer panel 30.

Proximate to the side flange 44, a lock mechanism mounting window 50 is provided which is configured to receive and mount the lock mechanism 25 therein. The window 50 comprises a peripheral window edge 51 that defines upper and lower rectangular portions 52 and 53 and a semi-circular center mounting portion 54. This center mounting portion 54 has an expanded width relative to the upper and lower rectangular portions 52 and 53 which center mounting portion 54 is defined by arcuate window edges. Adjacent to these arcuate window edges, a pair of mounting holes 56 are provided horizontally aligned with each other.

Figure 4:
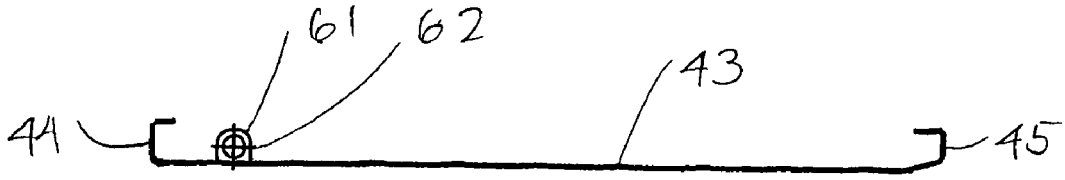
FIG. 4 is a plan view of an inner liner for the door assembly.
Figure 5:
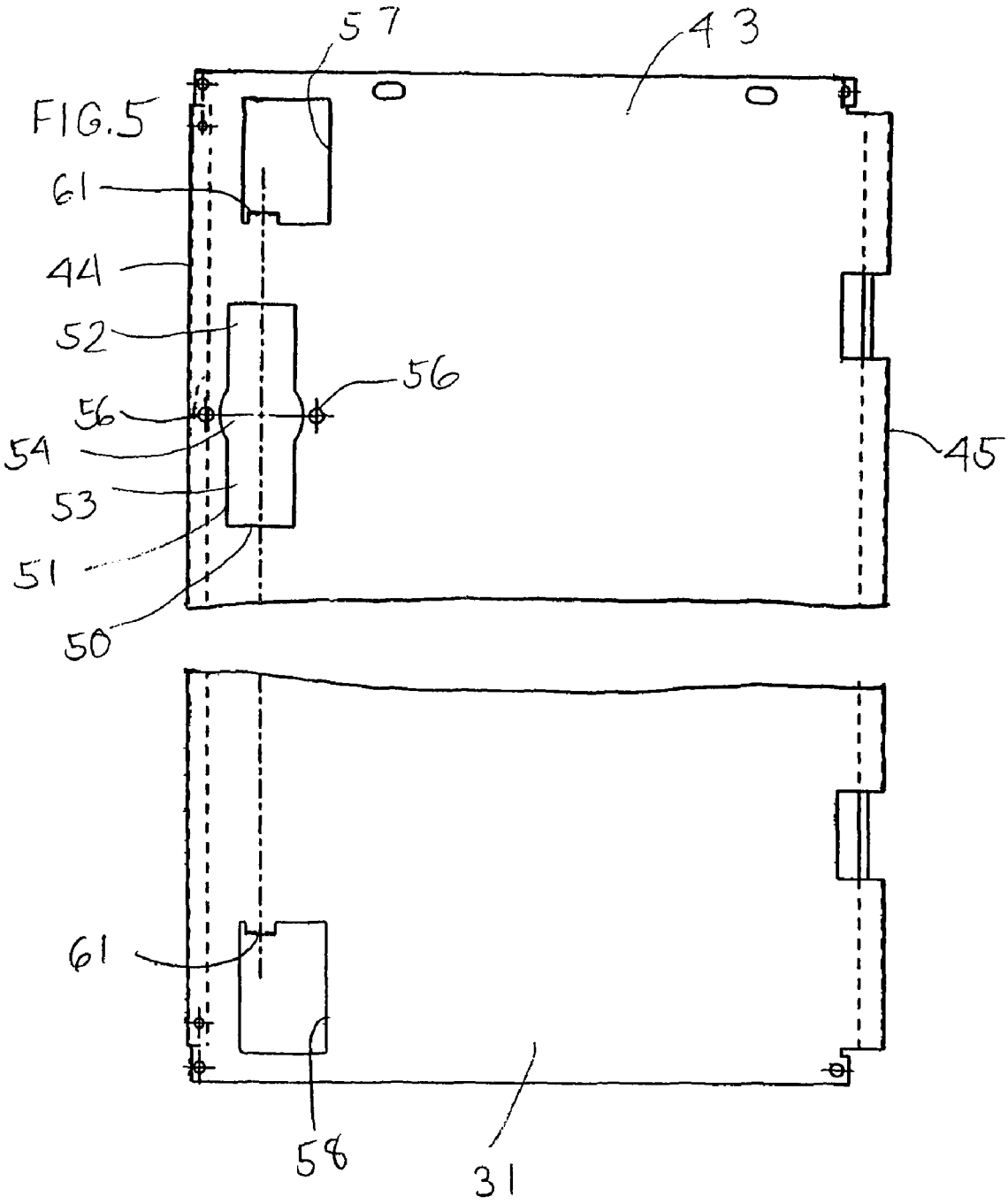
FIG. 5 is a rear elevational view thereof.

The inner liner 31 further includes rectangular window-like passages 57 and 58 through which the locking rods 26 and 27 exit from the hollow interior 59 that is defined between the outer panel 30 and the inner liner 31. To support the locking rods 26 and 27, each of the windows 57 and 58 has a guide flange 61 (FIG. 4) which includes a circular hole 62 extending vertically therethrough. The locking rods 26 and 27 are adapted to pass through the hole 62 of their respective guide flange 61 so that the locking rods 26 and 27 are vertically displaceable by the lock mechanism 25.

Referring to FIG. 3, the lock mechanism 28 is clamped to the mechanism window 50 and is operatively engaged with the slidable locking rods 26 and 27 so as to effect vertical displacement of the rods 26 and 27 between the locking and unlocking positions. Once the lock mechanism 28 is positioned in and affixed to the mechanism window 50, the lock assembly 25 further includes a snap fit cover 64 (FIG. 3) which snap fittingly engages the window edge 51 of the inner liner and is supported thereon.

Generally, the lock mechanism 28 is first clamped to the inner liner 31 when the inner liner 31 is still separate from the outer panel 30. This therefore provides for ready access to the inner liner 31 and the lock mechanism 28 after which, the lock mechanism 28 is clamped in place by fasteners 65 (FIG. 2) which are adapted to be threaded forwardly from the rear of the inner liner 31 as generally seen in FIG. 2. Initially, the lock mechanism 28 temporarily attached to the inner liner 31 so that there is some limited displacement permitted for subsequent alignment with the lock aperture 22. After the inner liner 31 is fixedly mounted to the outer panel 30 by the appropriate fasteners 47, the lock mechanism 28 is then aligned with the corresponding aperture 22 formed in the outer door panel 30 (FIG. 1) after which the clamping fasteners 65 are fully seated in position to affix the lock mechanism 28 at a stationery position. This assembly process is discussed in further detail hereinafter.

Figure 6:
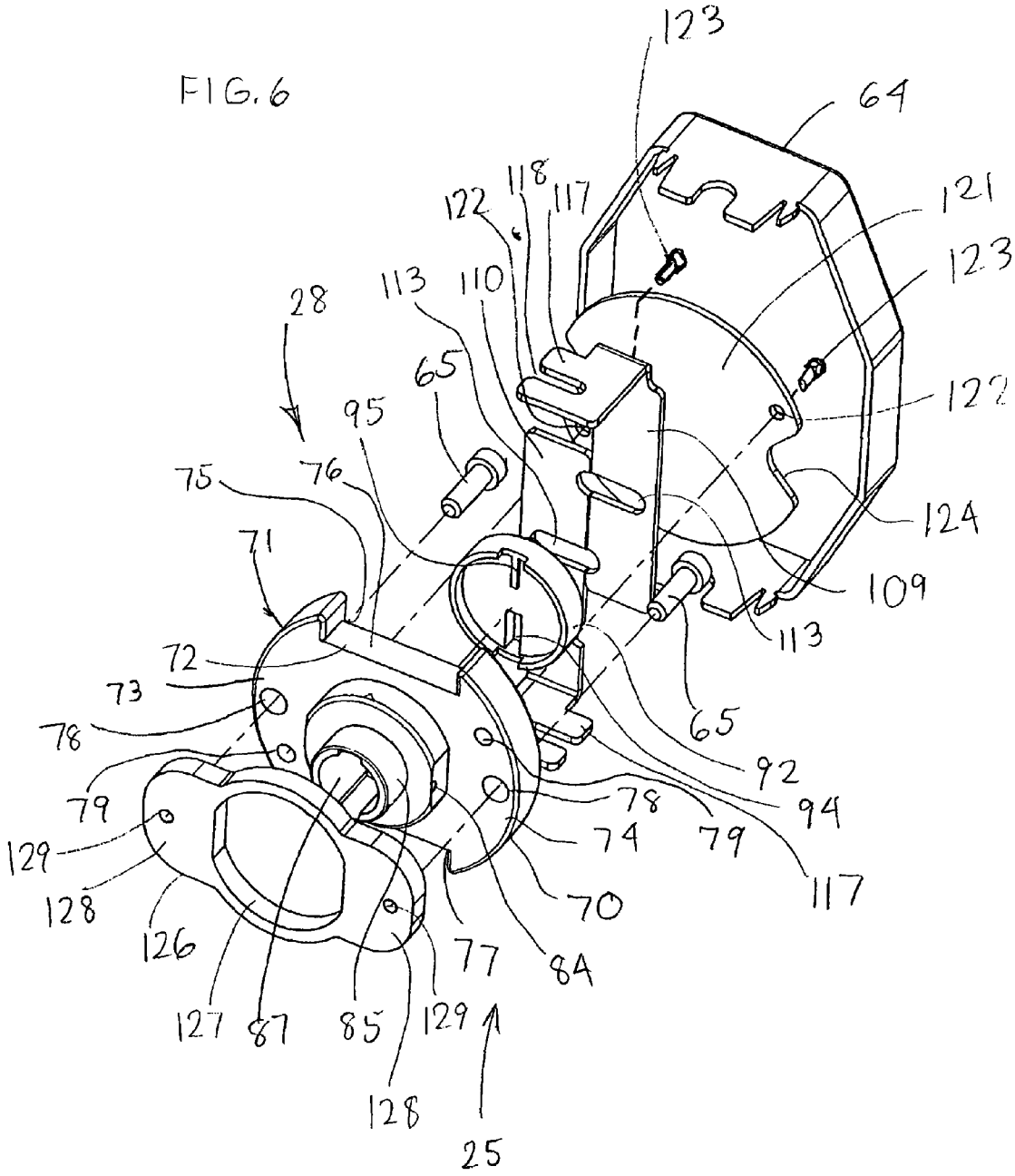
FIG. 6 is an exploded view of a lock assembly.

Referring to FIG. 6, the lock mechanism 28 is illustrated therein along with the snap fit cover 64. Turning first to the lock mechanism 28, this lock mechanism comprises a lock housing 70 which is formed of a rigid material such as metal. The lock housing 70 comprises a disc-like main body 71 which is generally circular but includes a central bridge 72. This central bridge 72 has a thickness which is thinner than the outer edge portions 73 and 74 so as to define a center lock chamber 75 extending vertically through the vertical thickness of the main body 71. This main body 71 further includes rectangular notches 76 and 77 and also includes a first pair of apertures 78 and a second pair of diametrically-opposed apertures 79 which apertures 79 are circumferentially offset relative to the apertures 78.

Additionally, the lock housing 70 includes a central hub 81 which projects forwardly of the main body 70 and has a generally circular shape. However, the outer circumferential surface 82 of the hub includes flats 83 on the opposite sides thereof. Additionally, this outer circumferential surface 82 includes a plurality of nubs 84 on the top, bottom and opposite left and right sides thereof. Still further, the central hub 81 includes a cylindrical socket 85 projecting forwardly from the central hub 81 and defining a central bore 87 extending horizontally through the entire thickness of the lock housing 70 so as to open from the opposite front and rear sides thereof. The bore 87 includes side slots 88 and 89 as seen in further detail in FIG. 7.

Figure 7:
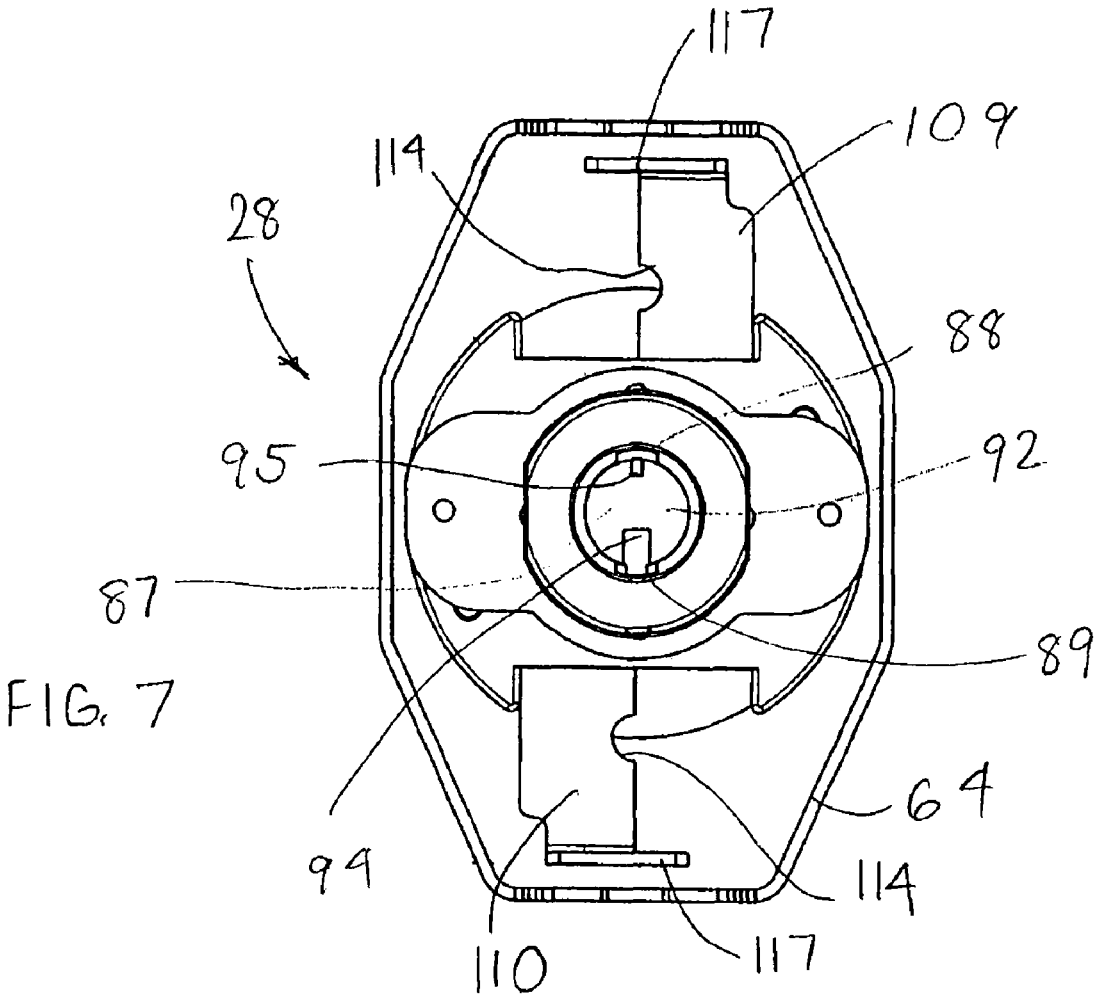
FIG. 7 is a front view of the lock assembly.

Turning next to FIGS. 6, 7 and 11, the lock mechanism 28 includes rotatable cam 92 which is adapted to be rotatably seated within the back of the main housing body 71. The cam 92 includes a keying slot 94 and a keying rib 95 which are configured so that the cam 92 may be rotated by an additional lock component that will be discussed in further detail hereinafter. Referring to FIG. 11, the cam 92 includes a pair of cam pins 96 which project rearwardly from the rear surface 97 of the cam 92.

More particularly, referring to FIG. 10, the socket 85 of the lock housing 70 is adapted to receive therein a conventional lock cylinder or plug 99 which is keyed so as to receive a conventional key 100. The cylinder plug 99 and key 100 are known and further discussion hereof is not required. Generally, the cylinder plug includes a drive pin 101 and a corresponding slot 102 wherein the pin 101 is adapted to be received within the keying slot 94 on the front side of the cam 92 while the plug slot 102 receives the corresponding keying rib 95 on the cam 92. As such, when the cylinder plug 99 is inserted into the bore 87 of the plug socket 85, rotation of the components of the lock plug 99 causes a corresponding rotation of the cam 92. Typically, this rotation is prevented unless the key 100 is inserted into the plug 99 to thereby permit rotation of the lock plug components in a conventional manner.

To effect vertical displacement of the locking rods 26 and 27, the aforementioned cam 92 is engaged with a pair of lock racks 109 and 110 (FIGS. 6, 7, 12 and 13).

Figure 12:
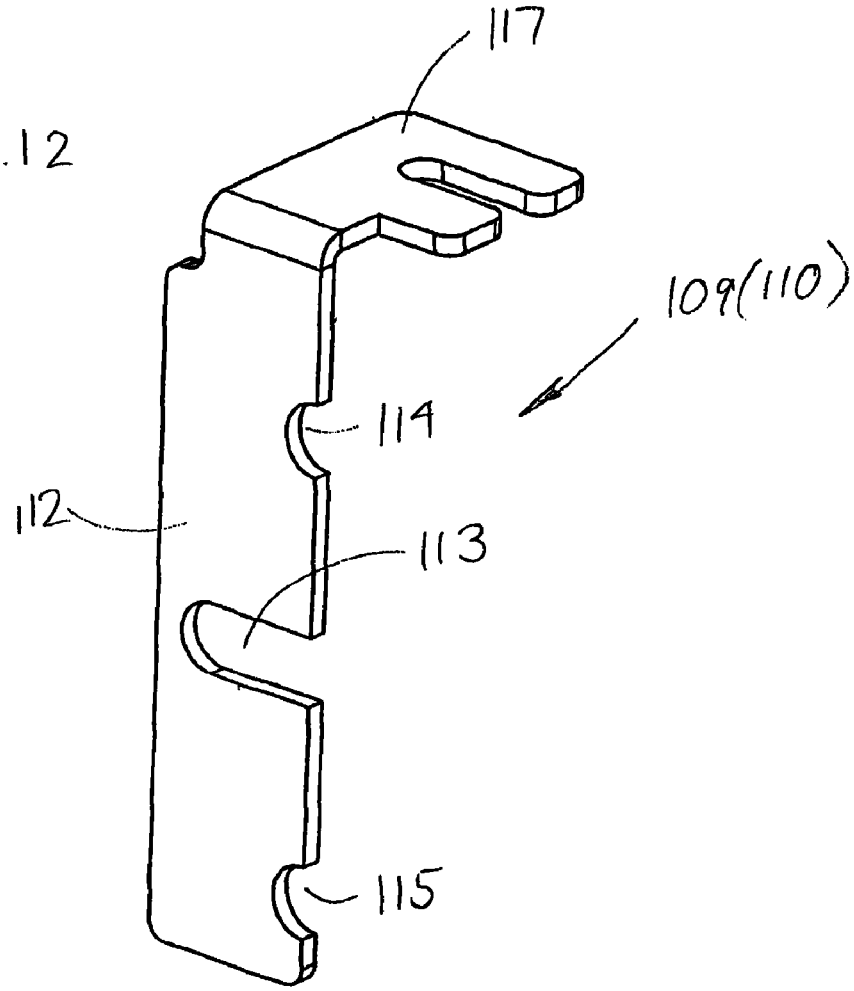
FIG. 12 is a rear view of a slidable lock rack.
Figure 13:
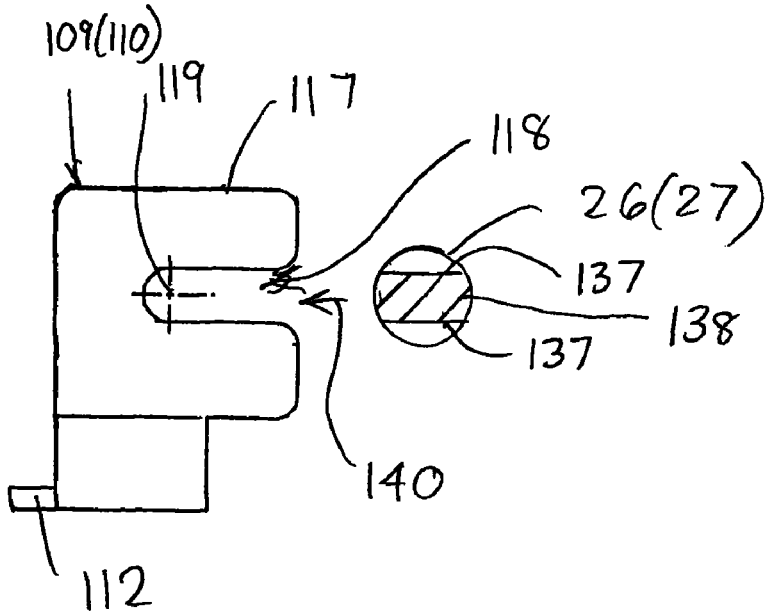
FIG. 13 is a plan view of the lock rack.
Figure 14:
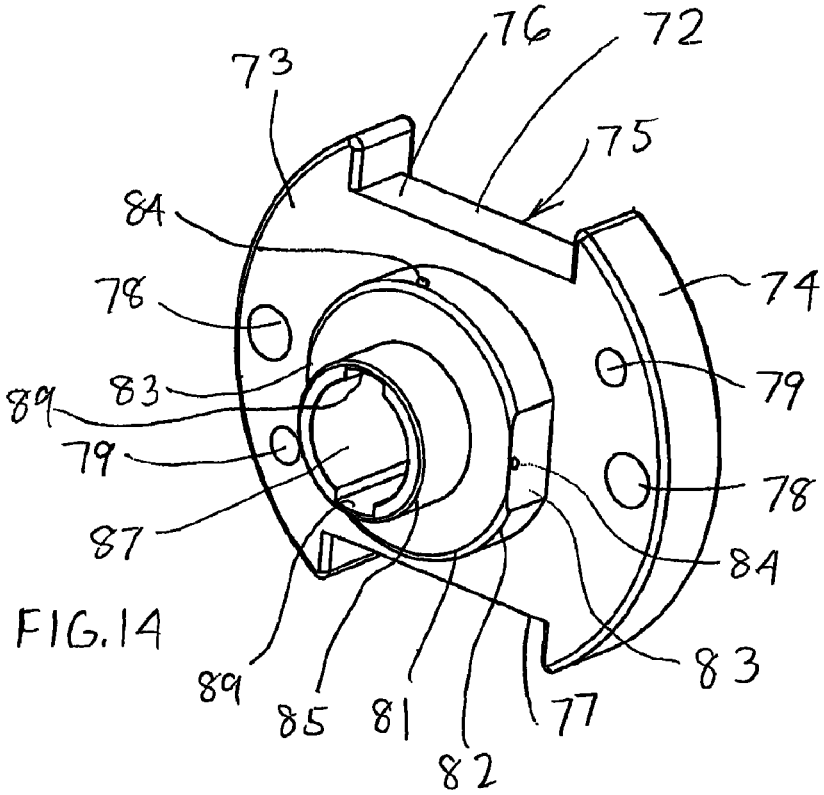
FIG. 14 is a front isometric view of a lock housing.

Referring to FIGS. 12 and 13, each of the lock racks 109 and 110 is essentially formed identical to each other and thus, the primary discussion that follows refers to lock rack 109. It will be understood that the construction of lock rack 110 is essentially the same with the difference being in the installed orientation.

The lock rack 109(110) as seen in FIGS. 12 and 13 comprises the main body 112 which is vertically elongate and includes a center cam slot 113 therein. Cam slot 113 opens sidewardly and is adapted for alignment with a corresponding notched portion of the other of the lock racks 109 and 110. The main rack body 112 further includes a pair of notched portions 114 and 115 which are essentially adapted to define the end of the cam slot 113 when aligned with the other of the lock racks 109 or 110. This alignment of the cam slots 113 and notch portions 114 and 115 is generally illustrated in FIG. 6. When the two lock racks 109 and 110 are positioned sidewardly adjacent to each other in an inverted relationship, the cam slots 113 are oriented generally parallel to each other, yet vertically offset. These vertically offset cam slots 113 receive the corresponding pins 96 of the aforementioned rotatable cam 92. As such, rotation of the cam 92 causes the pins 96 to essentially displace sidewardly and vertically to cause a corresponding vertical displacement of the lock racks 109 and 110. However, the lock racks 109 and 110 essentially move in opposite vertical directions during rotation. FIG. 7 illustrates the lock racks 109 and 110 in an extended position wherein the corresponding locking rods 26 and 27 connected thereto would be in the locking position generally illustrated in FIG. 18. However, rotation of the rotatable cam 92 would effect vertical displacement of the locking rods 26 and 27 to the unlocked position generally illustrated in FIGS. 3 and 17.

Figure 16:
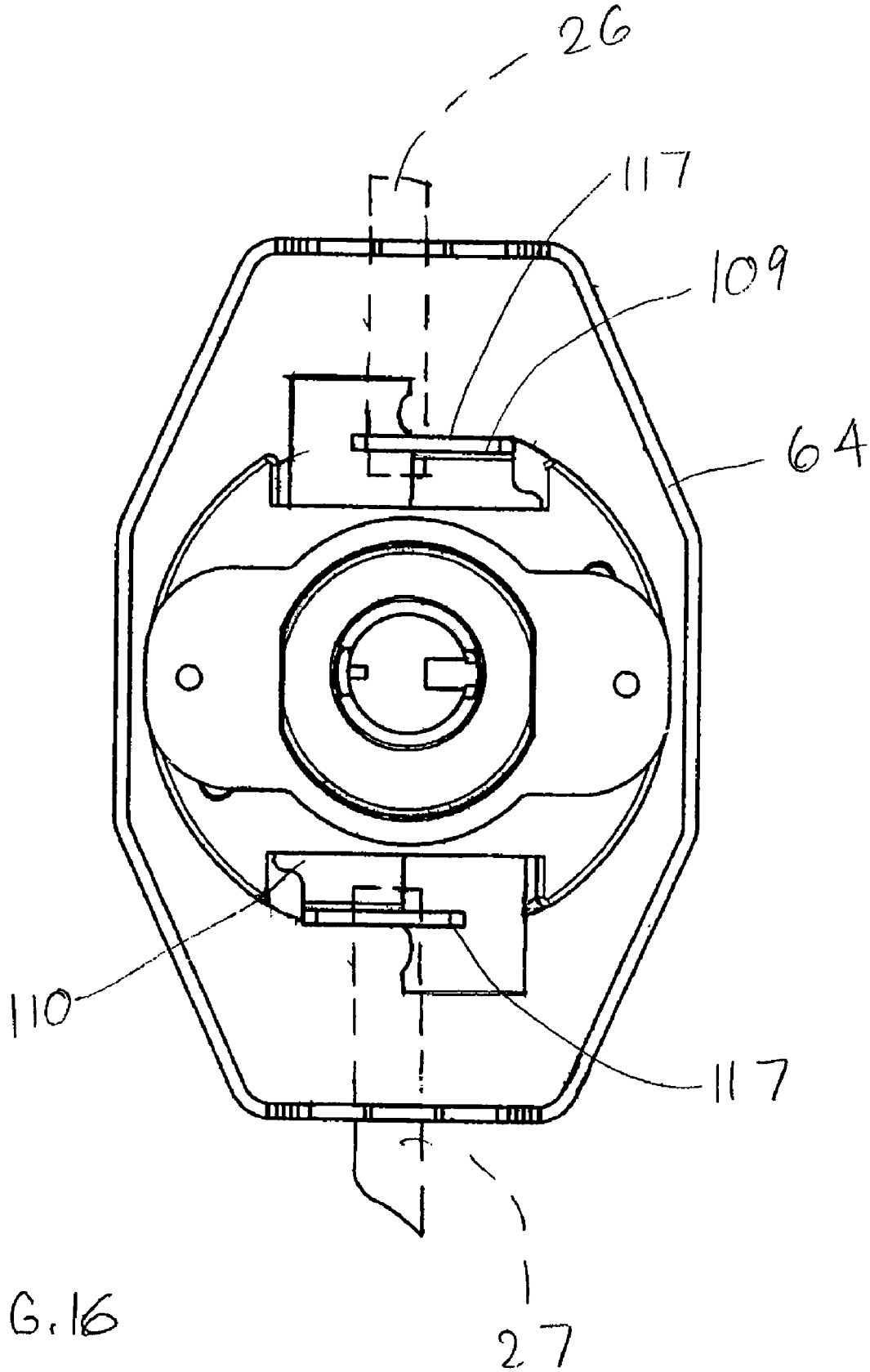
FIG. 16 is a front view of the lock assembly with slidable locking rods engaged to the lock racks.

Referring again to FIGS. 12 and 13, each lock rack 109 or 110 also includes an upstanding or horizontally oriented drive flange 117. Each drive flange 117 includes a horizontally elongate open-ended connector slot 118 wherein the center 119 of the connector slot 118 is generally oriented at the center of the lock rack 109 or 110. As such, the center of each slot 117 is generally vertically aligned with each other when the lock racks 109 and 110 are assembled together as generally illustrated in FIG. 16.

To retain the lock housing 70, rotatable cam 92 and the lock racks 109 and 110 together in an assembled condition, a rear plate 121 is provided (FIG. 6) which rear plate 121 includes a pair of fastener holes 122. These fastener holes 122 align with the pair of apertures or holes 79 wherein fasteners 123 (FIG. 6) are threadedly engaged through the fastener holes 122 and threadedly engaged with the corresponding bores 79 in the lock housing 70. This rear plate 121 thereby encloses and retains the various components together while permitting rotation of the lock cam 92 and vertical sliding of the lock racks 109 and 110 together through the chamber 75 in response to rotation of the cam 92.

Figure 8:
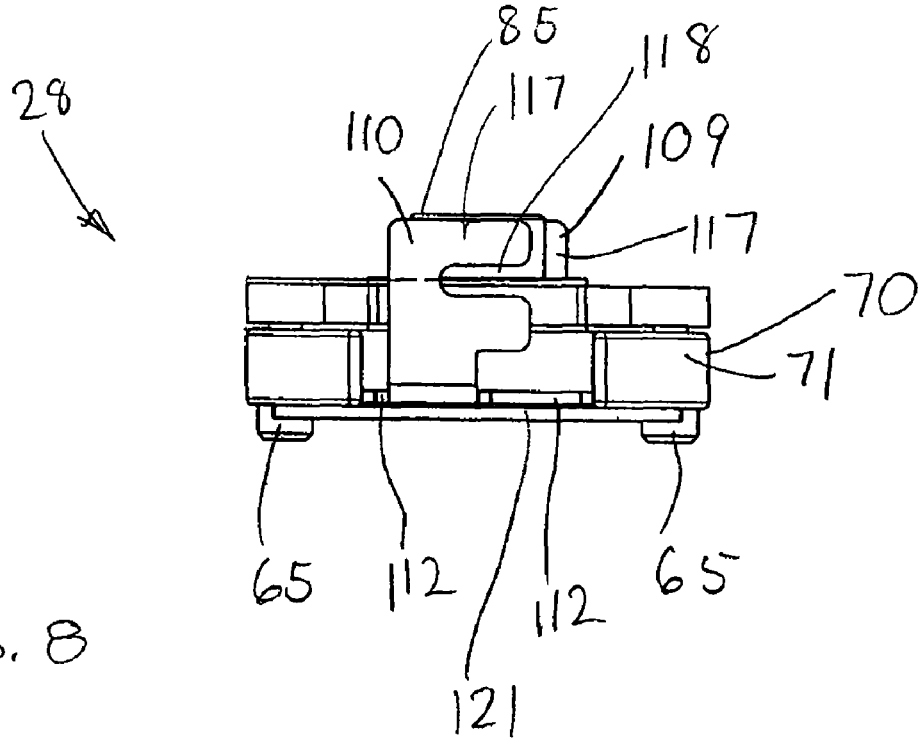
FIG. 8 is a bottom view of the lock assembly.

The rear plate 121 further includes clearance notches 124 on the opposite sides thereof which generally align with the fastener bores 78 so as to permit ready access to these bores 78 from the rear of the lock mechanism 28 (as seen in FIG. 8). When assembled together, the lock mechanism 28 is an assembled sub-assembly as seen in FIG. 8. During the assembly process, this lock mechanism 28 is positioned in the lock window 50 of the inner liner 31 and is configured to be fixedly mounted therein.

More particularly, to affix the lock mechanism 28 in position, the lock assembly 28 further includes a clamping plate 126. The clamping plate 126 includes a center aperture 127 that is adapted to slidably, yet non-rotatably fit over the central hub 81 of the lock housing 70. The aforementioned central housing hub 81 includes the nubs 84 so that the locking plate 126 may be snapped onto the central hub 81 during the pre-assembly phase.

Figure 15:
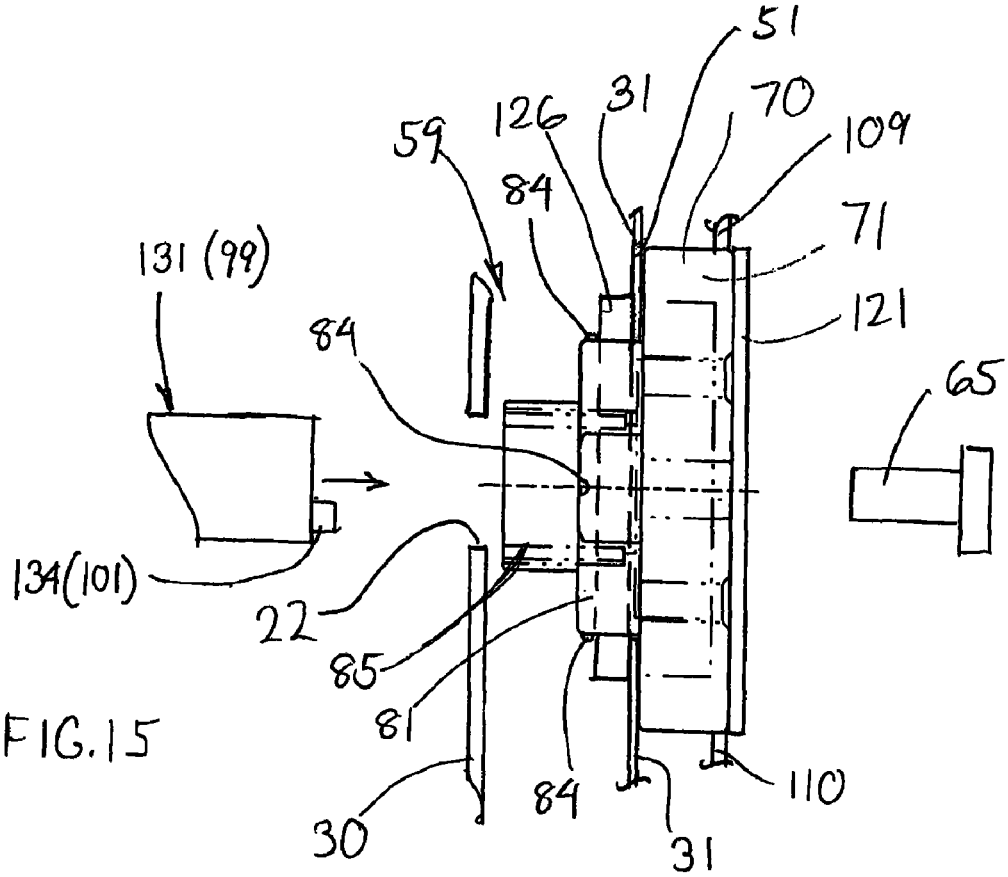
FIG. 15 is an exploded side view of the lock assembly being mounted to the door assembly.

When the locking plate 126 is snapped over the nubs 84, this clamping plate 126 has the window edges 51 of the inner liner 31 sandwiched between this clamping plate 126 and the opposing face of the main housing body 71 as seen in FIG. 15. To affix the lock mechanism 28 in a fixed position, the clamping plate or ring 126 includes sidewardly extending wings 128 which include fastener bores 129 respectively therein. These fastener bores 129 are adapted to be in coaxial alignment with the corresponding bores 78 of the housing 70 so as to receive the fasteners 65 horizontally therethrough.

During mounting of the lock mechanism 28 to the inner liner 31, the lock mechanism 28 is first positioned within the window 50, and then the clamping plate 126 is snapped over the nubs 84 onto the central hub 81. This results in the fastener bores 129, 78 and the additional holes 56 in the inner liner 31 to be coaxially aligned with each other and allow for receipt of the fasteners 65 therethrough. These fasteners 65 fixedly engage with the bores 129 so as to then draw the clamping plate 126 rearwardly and thereby clamp the window edges of the window 50 between the opposing surfaces of the clamping plate 126 and the main housing body 71.

Preliminarily, these fasteners 65 do not need to be tightly fastened to allow some repositioning of the lock mechanism 28 when it is preliminarily mounted to the inner liner 31. Once the inner liner 31 is mounted to the outer panel 30 as will be described in further detail herein, the lock mechanism 28 is positioned as needed to be in alignment with a lock aperture 22 and then fixed in position by final tightening of the fasteners 65.

More particularly as to this assembly process, FIG. 9 illustrates a mounting tool 131 which has a cylindrical solid body 132 that has the same circumference as the lock plug 99 so as to fit within the bore 87 of the socket 85. This tool body 132 has an end face 133 provided with a drive pin 134 and a keying slot 135. The pin 134 and slot 135 are essentially equivalent to the pin 101 and slot 102 of the lock plug 99. Thus, when the tool body 132 is inserted through the lock aperture 22 of the outer panel 30 and then into the socket bore 87, rotation of this tool body 132 causes rotation of the rotatable cam 92.

To assist in rotation of the tool body 132, this tool body 132 also includes a transverse rod 137 that extends through the tool body 132 and essentially serves as a hand piece for manual rotation of this alignment tool 131. This allows for testing of the various components of the lock mechanism 28. Further, by inserting the alignment tool or fixture 131 through the lock aperture 22, this ensures alignment of the lock aperture 22 with the corresponding socket bore 87. If the bore 87 is slightly out of alignment with the lock aperture 22, the locking tool 132 essentially ensures coaxial alignment of these formations which is accomplished by the necessary displacement of the lock mechanism 28 until such alignment is achieved. With the tool 132 still inserted in its aligning position, the fasteners 65 described above are then tightened so as to affix the lock mechanism 28 in its final fixed position.

Thus, during the assembly process, the lock mechanism 28 is preliminarily clamped to the inner liner 31 and then the inner liner 31 is mounted to the outer panel 30. Thereafter, the alignment tool 132 is fitted into and through the lock aperture 22 into the socket bore 85 after which, the fasteners 65 are tightened down to secure the lock mechanism 28 in its fixed position. This step is generally depicted in FIG. 15. Thereafter, the alignment tool 132 is removed and the lock plug 99 is affixed inside of the socket bore 87 in a final position which also is represented by the same structural illustration of FIG. 15. As a result, the cam 92 and lock racks 109 and 110 are effectively operated solely by the key 100. Rotation of the key 100 thereby effects rotation of the lock cam 92 so as to displace the lock racks 109 and 110 vertically and cause a corresponding controlled movement of the slide rods 26 and 27.

In addition to the foregoing unique features of the lock mechanism 28 and the mounting process therefore, the invention further embodies a unique connector arrangement for connecting the slide rods 26 and 27 to their corresponding lock racks 109 and 110.

More particularly, the connection between the sliding rods 26 and 27 is readily accomplished without the use of separate fasteners.

Figure 17:
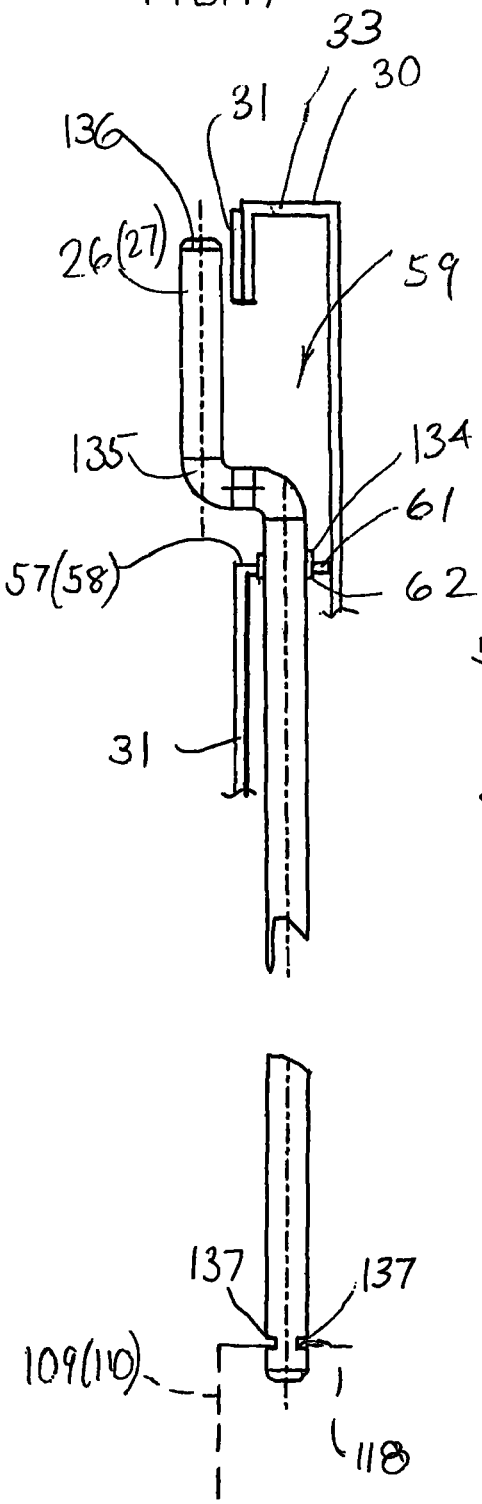
FIG. 17 is a partial side cross-sectional view of the slidable locking rod slidably supported in the door assembly in an unlocked position.
Figure 18:
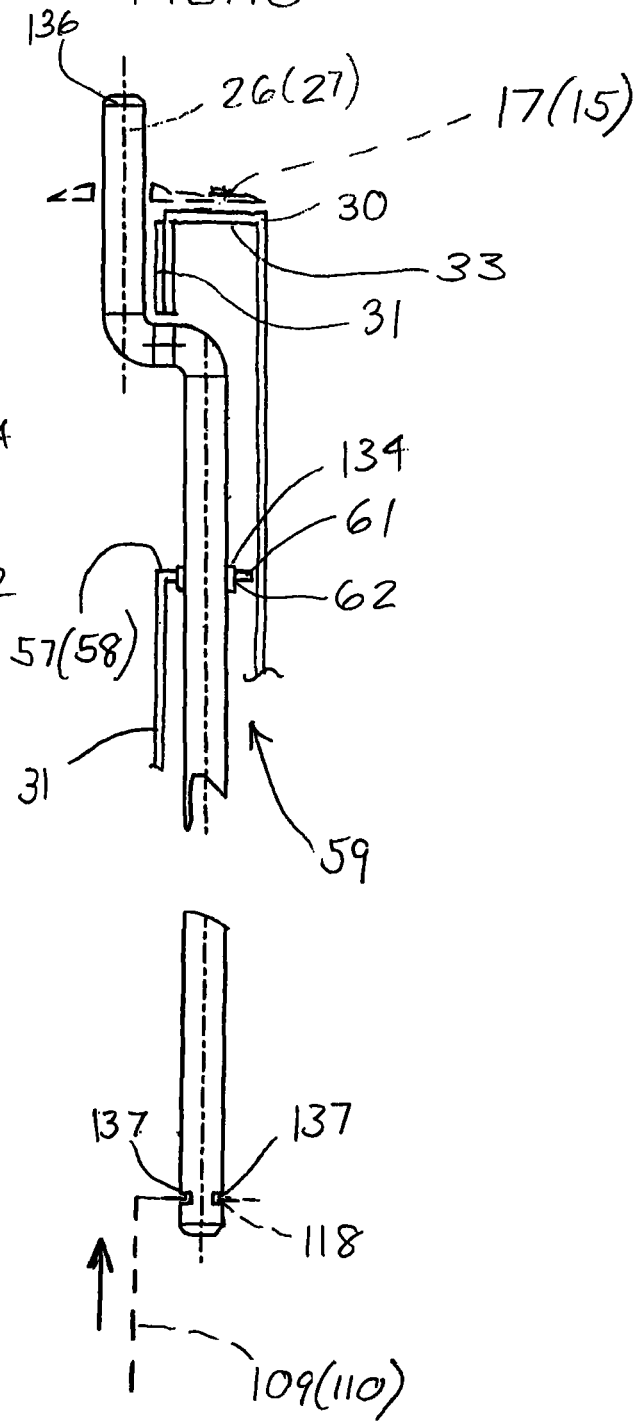
FIG. 18 illustrates the locking rod displaced upwardly to a locking position.
Figure 19:
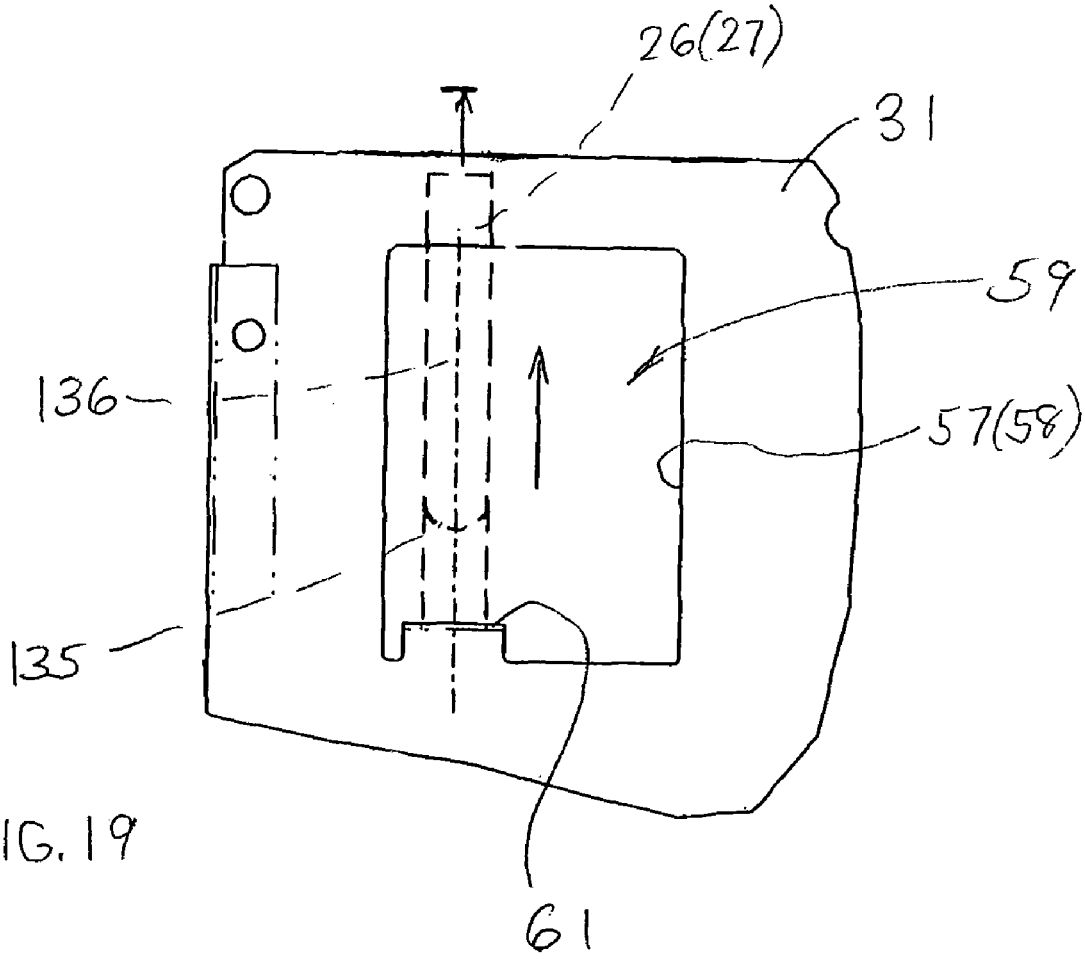
FIG. 19 is an enlarged partial rear elevational view with the locking rod illustrated in phantom outline.
Figure 20:
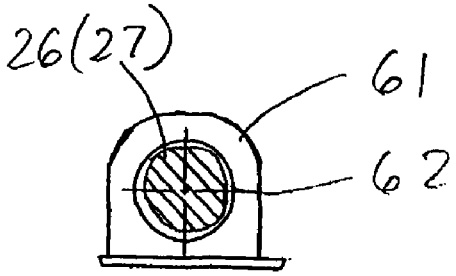
FIG. 20 is a top cross-sectional view illustrating the locking rod slideably supported in a guide flange of the inner liner.

With respect to the sliding rods 26 and 27, these rods are illustrated in further detail in FIGS. 17 and 18. It will be understood that the rods 26 and 27 are formed and supported substantially identical to each other except that the vertical length of each rod 26 or 27 may vary relative to each other depending upon the vertical distance between the lock mounting window 50 and the respective upper or lower edges of the door assembly 12 which may vary as discussed above relative to FIG. 1. The interconnection of each rod 26 or 27 is the same as each is mounted on the inner liner 31 and cooperates with an adjacent top or bottom cabinet wall 17 or 15 in substantially the same manner. As such, the following discussion will refer specifically to rod 26, it being understood that this discussion also applies equally to rod 27.

The rod 26 is confined within the hollow interior 59 defined between the outer panel 30 and the inner liner 31 wherein the upper end of the rod 26 is slidably supported in the guide flange 61 and within an annular plastic guide 134. The locking end of the rod 26 is then stepped inwardly at stepped portion 135 so as to exit through the respective rod passage or window 57 (58). The rod 26 then extends vertically and terminates at an engagement section 136 which is moveable vertically from the retracted position of FIG. 17 to the extended, locking position of FIG. 18 in response to vertical displacement of the locking rod 26 (27) by actuation of the lock mechanism 28 described above.

To readily connect the locking rod 26 to the lock mechanism 28, the second end of the rod 26 includes slots 137 which extend sidewardly across opposite sides of the rod 26 at the innermost drive end thereof. These slots define an engagement section 138 which is sized to slide sidewardly or transversely into the corresponding slot 118 on the lock rack 109 or 110 as generally illustrated by reference arrow 140 in FIG. 13. Therefore, during assembly, the lock mechanism 28 is mounted in position on the inner liner 31, after which, the lower or upper innermost free end of the appropriate rod 26 or 27 is slid sidewardly into the corresponding slot 118 in the corresponding lock rack 109 or 110. By this cooperation of the slotted rod portion and the corresponding slot in the rack 109 or 110, vertical movement of the racks 109 and 110 causes a corresponding vertical displacement of the locking rod 26 or 27. In particular, when the lock racks 109 and 110 are extended as seen in FIG. 7, the lock rods 26 and 27 are then driven or displaced upwardly as seen in FIG. 18. These same rods 26 or 27 may then be retracted to the position of FIG. 17 when the racks are driven inwardly together to the position of FIG. 16.

To prevent disengagement of the rod 26 or 27 from the appropriate rack 109 or 110, the aforementioned cover 64 is provided to essentially cover the lock mechanism 28 while performing the secondary function of guiding the locking rod 26 and 27 and preventing transverse or sideward displacement of the rod out of engagement with the corresponding rack 109/110.

Referring more particularly to FIGS. 21-23, the cover includes a peripheral side wall 145 having opposite end portions 146 and 147. These opposite end portions 146 and 147 each include an identical arrangement of downwardly depending guide flanges 149. These guide flanges 149 define a guide slot 150 therebetween. To secure the cover 64 in position, the edge of the side wall end portions 146 and 147 also have a pair of snap fit connector fingers 151 which are resiliently deflectable.

Figure 24:
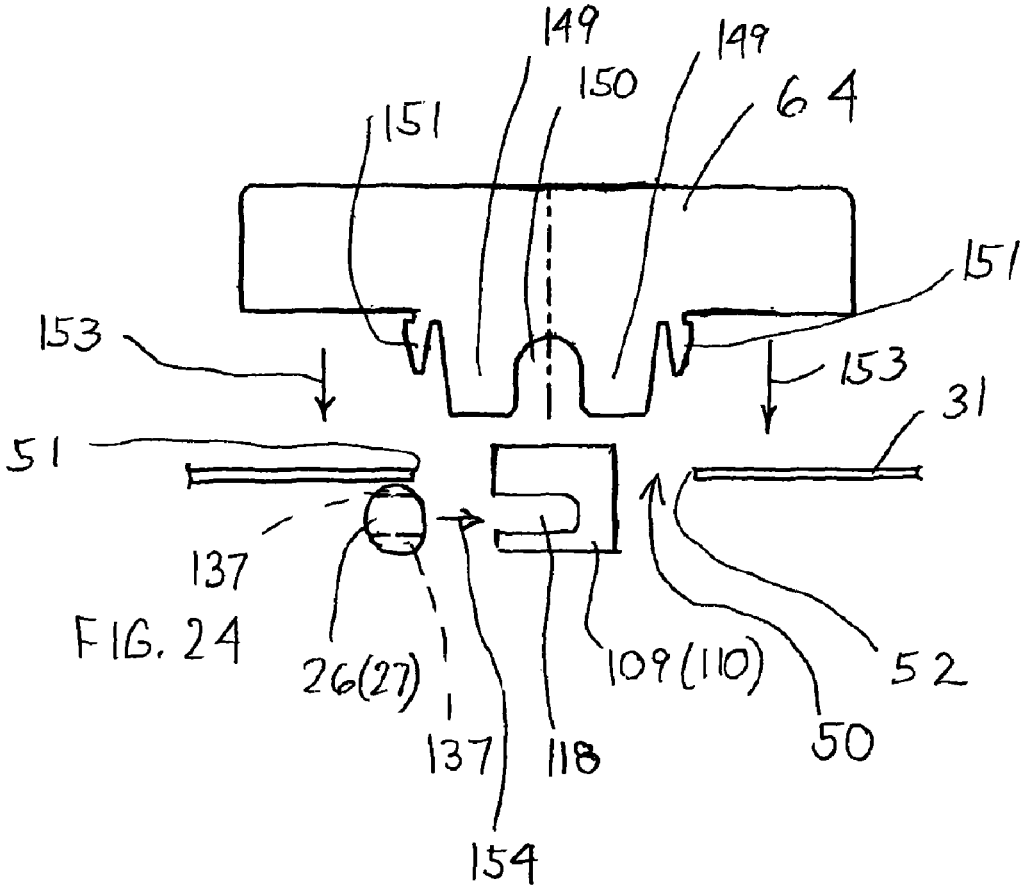
FIG. 24 is a diagrammatic top view illustrating the cover being mounted to the inner liner.
Figure 25:
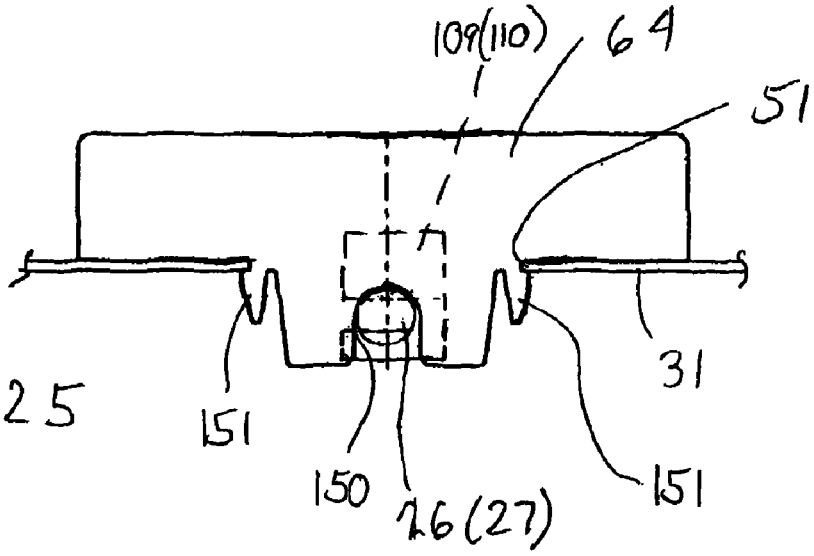
FIG. 25 illustrates the cover snap fittingly engaged with the inner liner.

Referring to FIGS. 24 and 25, these connector fingers 151 are adapted to be deflected inwardly so as to snap onto and secure against the window edge 51 of the rectangular portion 52 of the lock mechanism window 50 as seen in FIG. 25. Therefore, the cover may be moved into position as indicated by reference arrows 153 in FIG. 24 and then snapped onto the lock mechanism window 50 as seen in FIG. 25.

During the assembly process, FIG. 24 illustrates the locking rod 26 being displaced sidewardly into the rack slot 118 as indicated by reference arrow 154 after which the rod 26 is in the confined position illustrated in FIG. 25. The guide slot 150 of the cover 64 thereby is aligned with the rod 26 and fits over the rod 26 as seen in FIG. 25. This guide slot 150 permits vertical or longitudinal movement of the locking rod 26 or 27 while preventing transverse or sideward displacement of the rod 26 out of the rack slot 118. By this arrangement, the components can be readily assembled together without requiring separate fasteners to join the locking rods 26 and 27 with the corresponding lock racks 109 and 110. Thus, disengagement of these components is prevented by merely snapping the cover 64 onto the edges of the mechanism window 50.

Although particular a preferred embodiment of the invention has been disclosed in detail for illustrative purposes, it will be recognized that variations or modifications of the disclosed apparatus, including the rearrangement of parts, lie within the scope of the present invention.

What is claimed is:

1. A door assembly for a storage cabinet comprising:

a door having a lock window therein within an interior portion thereof, which said window has an edge comprising crosswise spaced-apart edge portions, and at least one locking rod which is slidably supported by said door so as to be movable in a drive direction along a respective slide path, said at least one locking rod having a lock end disposed adjacent an edge of said door so as to be movable to an extended position to lock the door and a retracted position to permit opening of said door, said at least one locking rod further including a drive end disposed proximate said lock window; and a lock mechanism having a lock housing mounted to said door such that said lock mechanism is disposed within said lock window, said lock mechanism further including at least one lock rack which is slidable in a drive direction along a respective drive path and said lock mechanism further including an actuator accessible from an exterior of said door to effect selected displacement of said at least one lock rack along said respective drive path during operation of said lock mechanism, said at least one lock rack and said drive end of said at least one locking rod being transversely engagable with each other during assembly thereof such that displacement of said at least one lock rack along said respective drive path effects displacement of said at least one locking rod along said respective slide path during operation of said lock mechanism to effect locking and unlocking of said door, said drive end of said at least one locking rod and said at least one lock rack including cooperating engagement portions which define an engagement path extending in a transverse direction oriented transverse to said drive path and extending crosswise relative to said lock window, said engagement portions being inter-fitted with each other during assembly by displacement of said drive end in an engaging first direction along said engagement path to transversely engage said engagement portions with each other, said at least one lock rack including a transverse slot which has an open slot end that opens sidewardly transverse to said drive path and a closed slot end spaced transversely away from said open slot end wherein said slot defines said engagement path extending between said open and closed slot ends, said drive end being slidably insertable transversely into said transverse slot of said at least one lock rack in said first direction through said open slot end and being movable along said engagement path so as to be seated within said closed slot end to assemble said at least one locking rod with said at least one lock rack, said engagement portions being defined by transversely-extending edges of said slot and a narrowed portion of said drive end which interfit together, said interfitted engagement portions being interfit to permit reversible transverse displacement of said drive end relative to said at least one lock rack along said engagement path in said first direction and an opposite second direction to effect transverse engagement and disengagement of said engagement portions during assembly and disassembly while simultaneously preventing separating displacement of said drive end relative to said at least one lock rack in said drive direction such that said at least one locking rod is displaced along said respective slide path in unison with said at least one lock rack when moving along said respective drive path during operation of said at least one lock rack; and a lock mechanism cover which is releasably fixed to said door so as to overlie said lock mechanism, said cover including a rod guide for said at least one locking rod which defines a guide slot that opens into said lock window and receives said at least one locking rod after assembly of said at least one locking rod and said at least one lock rack, said guide slot limiting movement of said drive end crosswise to said lock window to restrain said reversible transverse displacement of said drive end of said at least one locking rod in said first and second directions along said engagement path which prevents transverse disengagement and disassembly of said at least one locking rod from said at least one lock rack in said second direction, said rod guide permitting longitudinal sliding of said at least one locking rod along said respective slide path when driven by said at least one lock rack during operation.

2. The door assembly according to claim 1, wherein said cover is snap-lockingly engaged to said door.

3. The door assembly according to claim 2, wherein said cover snap-lockingly engages said edge of said window within said door.

4. The door assembly according to claim 1, wherein said narrowed portion comprises a grooved portion formed in said drive end which receives the edges of said slot of said at least one lock rack therein.

5. The door assembly according to claim 1, wherein transverse displacement of said drive end relative to said at least one lock rack in said second direction along said engagement path and transverse disengagement of said at least one locking rod along said engagement path from said at least one lock rack are solely prevented by said cover which prevents disengaging transverse displacement of said drive end along said engagement path in said second direction.

6. A method of assembling a lock assembly to a door wherein said door comprises an outer panel and an inner liner which is mountable to said outer panel, said method comprising the steps of:

providing said inner liner separate from said outer panel, said inner liner having opposite first and second side surfaces on opposite first and second liner sides;

providing a lock mechanism having a lock housing and a clamp member supported by said lock housing, said lock housing and said clamp member defining respective opposed first and second clamp surfaces wherein said first and second clamp surfaces face towards each other and define a clamping space therebetween;

clamping said lock assembly to said inner liner in an initial position by capturing said inner liner in said clamping space between said lock housing disposed on said first liner side and said clamp member disposed on said second liner side and drawing said first and second clamp surfaces toward each other with said first and second clamp surfaces being drawn respectively toward and respectively acting on said first and second side surfaces of said inner liner so that said inner liner is clamped by said first and second clamp surfaces wherein said first and second clamp surfaces directly contact said first and second side surfaces; and affixing said inner liner to said outer panel to define a door assembly wherein said lock assembly is aligned with a corresponding lock aperture in said outer panel such that said lock mechanism is positioned adjacent the lock aperture by the respective positioning of said inner liner.

7. The method according to claim 6, further comprising the step of initially clamping said lock mechanism to said inner liner in a preliminary condition wherein said lock mechanism is supported by but movable on said inner liner along said first and second side surfaces, inserting an alignment member through said lock aperture of said outer panel when said inner panel and said outer panel are affixed together, positioning said alignment member and said lock mechanism to displace said lock mechanism along said first and second side surfaces to a desired position, and finally clamping said clamp assembly to said inner liner in a stationary position.

8. The method according to claim 6, further comprising the step of providing fasteners between said lock housing of said lock mechanism and said clamp member wherein the clamping step further comprises the step of finally tightening said fasteners to draw said lock housing and said clamp member together with said inner liner disposed therebetween in said clamping space and to affix said lock mechanism in a stationary position on said inner liner after said inner liner is affixed to said outer panel.

9. The method according to claim 8, wherein said lock assembly is finally positioned after said inner liner is affixed to said outer liner, and after said final positioning, said lock mechanism being affixed in said stationary position.

10. The method according to claim 6, wherein said door includes slidable locking rods which are drivingly engaged to said lock mechanism to effect locking and unlocking of said door by operation of said lock mechanism, said method further comprising the step of attaching drive ends of said locking rods to said lock mechanism after said inner liner is affixed to said outer panel.

11. A lock mechanism for a door comprising:

a lock housing adapted to receive a lock plug therein to drivingly rotate a cam member, said lock plug being accessible from a front of said lock housing;

at least one lock rack slidably supported on said lock housing so as to be movable linearly along a drive path, said at least one lock rack being engaged with said rotatable cam member such that rotation of said cam member effects linear displacement of said at least one lock rack along said drive path, said at least one lock rack including a transverse slot which has an open slot end that opens sidewardly transverse to said drive path and a closed slot end spaced transversely away from said open slot end wherein said slot defines an engagement path extending between said open and closed slot ends, said engagement path being oriented transverse to said drive path;

at least one locking rod slidably supported on a door, said at least one locking rod having a drive end adjacent said lock mechanism which slidably inserts transversely into said transverse slot of said at least one lock rack in a first direction through said open slot end and is movable along said engagement path so as to be seated within said closed slot end to assemble said at least one locking rod with said at least one lock rack, transversely-extending edges of said slot interfitting with a narrowed portion of said drive end to permit transverse sliding of said drive end between said open and closed slot ends in said first direction and an opposite second direction during assembly and disassembly while said edges simultaneously prevent relative movement between said at least one lock rack and said at least one locking rod in the direction of said drive path during both assembly and operation of said lock mechanism such that movement of said at least one lock rack along said drive path effects displacement of said at least one locking rod during operation; and a clamp member releasably mounted to said lock housing which is engageable with fasteners to clampingly mount said lock housing to a thin door panel during assembly therewith wherein said lock housing and said clamp member define opposed clamping surfaces which define a space therebetween which is configured to receive the door panel therebetween in clamped engagement, and wherein said fasteners draw said clamping surfaces together for fixed clamping engagement with said door panel; and said lock plug being accessible from a forward side of said lock mechanism and said clamp member being engaged to said lock housing by said fasteners which are accessible from a rear of said lock housing to draw said clamping surfaces together.

12. The lock mechanism according to claim 11, wherein said clamp member has a relatively narrow shape which permits insertion into an elongated slot on said door panel and rotation of said lock mechanism to position said clamp member in a clamping position for subsequent clamping by said fasteners.

13. The lock mechanism according to claim 11, wherein said at least one lock rack has an upstanding flange at an end thereof which defines said engagement slot.

14. The lock mechanism according to claim 13, which further includes a removable guide cover which encloses a rear of said lock housing, said guide cover including guides which project from a main body thereof for guiding engagement with said at least one locking rod to restrain transverse displacement of said at least one locking rod out of engagement with said at least one lock rack when said cover is in a fixed position relative to said lock housing.

15. The lock mechanism according to claim 14, wherein said cover includes snap connectors for snap fitting engagement of said cover to a door panel after said lock assembly is clamped in position.

16. The lock mechanism according to claim 15, wherein said cover is a molded plastic cover.

17. The lock mechanism according to claim 11, wherein said lock plug is removable from a bore defined within said lock housing, said lock mechanism further including an alignment tool which is fittable into said bore in the absence of said lock plug to permit manual positioning of said lock assembly within a door panel for subsequent clamping by said clamp member.

18. The lock mechanism according to claim 17, wherein said alignment tool is removable from said bore to permit insertion of said lock plug after said lock assembly is mounted to said door panel.

19. A cabinet door assembly comprising:

an outer door panel defined by a rigid thin skin defining an outer surface of said door assembly and including a lock aperture therein;

an inner door member mountable to the interior of said outer panel, said inner door member comprising opposite first and second sides, which define first and second side faces, and comprising a lock mounting window disposed adjacent said lock aperture;

a lock mechanism containing a lock unit alignable with said lock aperture for releasably locking said door assembly, said lock mechanism including a lock housing positionable within said lock mounting window and a clamping member movably supported on said lock housing which captures said inner door member between a first surface of said clamping member, which is disposed on said first side of said inner door member in direct contact with said first side face, and an opposing second surface on said lock housing, which is disposed on said second side in direct contact with said second side face, said edge portions of said lock mounting window being clamped tightly by said clamping member acting on said first side face of said first side and said lock housing acting on said second side face of said second side with said lock mechanism fixedly secured within said lock window adjacent said lock aperture of said outer door panel.

20. The door assembly according to claim 19, wherein said inner door member comprises an inner liner defined as a thin skin which is mountable to said outer door panel in facing relation.

21. The door assembly according to claim 20, wherein said lock housing includes a hub in which said lock unit is mounted, said hub having an outer hub surface and said clamping member being a ring which is mountable in surrounding relation to said hub and clamps said edge portions between said ring and said lock housing.

22. The door assembly according to claim 21, wherein said lock mechanism includes engagement members engagable between said lock housing and said clamping member to draw said lock housing and said clamping member together to thereby clampingly engage said window edges.

23. The door assembly according to claim 1, wherein said lock housing includes a space transversely adjacent said engagement portion of said at least one lock rack which receives said drive end when disengaged from said at least one lock rack and which permits transverse displacement of said drive end from said space to an engaged position where said engagement portions are transversely engaged, said cover restraining said drive end to prevent return transverse displacement of said drive end in said second direction back to said space when said cover is fixed to said door while said engagement portions prevent separation of said drive end from said at least one lock rack in said drive direction.

* * * * *